US007263957B2

(12) United States Patent
Miyakoshi et al.

(10) Patent No.: US 7,263,957 B2
(45) Date of Patent: Sep. 4, 2007

(54) EVALUATION METHOD OF DIAGNOSTIC FUNCTION FOR VARIABLE VALVE MECHANISM AND EVALUATION APPARATUS FOR VARIABLE VALVE MECHANISM

(75) Inventors: Ryo Miyakoshi, Iseaki (JP); Naoki Okamoto, Isesaki (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/272,875

(22) Filed: Nov. 15, 2005

(65) Prior Publication Data

US 2006/0106527 A1 May 18, 2006

(30) Foreign Application Priority Data

Nov. 18, 2004 (JP) ..... 2004-334725

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 5,495,830 A * 3/1996 Wu ..... 123/90.15
6,401,016 B1 * 6/2002 Yoshino et al. ..... 701/22
2004/0083071 A1 * 4/2004 Sawaoka ..... 702/113

FOREIGN PATENT DOCUMENTS

| | | |
|---|---|---|
| JP | 10-153104 A | 6/1998 |
| JP | 2000-73794 A | 3/2000 |
| JP | 2001-12262 A | 1/2001 |
| JP | 2001-164951 A | 6/2001 |

* cited by examiner

*Primary Examiner*—Thomas Denion
*Assistant Examiner*—Zelalem Eshete
(74) *Attorney, Agent, or Firm*—Foley & Lardner LLP

(57) ABSTRACT

Evaluation method of evaluating a diagnosing function for a variable valve mechanism of an engine valve in which a desired value used for feedback-control of the variable valve mechanism is subjected to a low-pass filter processing so as to produce a state such that a response delay of the variable valve mechanism is generated, and a transient response of the variable valve mechanism is diagnosed in this state. As a result, if it is not determined that a response delay is generated, it is determined that the diagnosing function is abnormal. An evaluation apparatus for carrying out the method is also disclosed.

25 Claims, 11 Drawing Sheets

EVALUATION METHOD OF DIAGNOSTIC FUNCTION FOR VARIABLE VALVE MECHANISM AND EVALUATION APPARATUS FOR VARIABLE VALVE MECHANISM

BACKGROUND OF THE INVENTION

1. Field of the Invention

The present invention relates to a method of and an apparatus for evaluating a diagnosing function to diagnose a transient response of a variable valve mechanism adapted for changing operating characteristics of an engine valve.

2. Description of the Related Art

Japanese Unexamined Patent Publication No. 2000-073794 discloses a technique in which a deviation between a desired value and an actual value of the operating characteristics of the engine valve is calculated, and when a state where the deviation exceeds a determination value continues for a time period which is equal to or more than a predetermined period of time, an occurrence of response delay in the variable valve mechanism is diagnosed.

If the diagnosing processing normally functions, it is possible to alert a driver to the abnormal condition that the response delay is increased. However, if the diagnosis processing does not function normally, the engine is operated in a state where the large response delay is generated, and the performance of the engine at the time of acceleration thereof accompanying switching of desired operating characteristics of the engine is deteriorated.

SUMMARY OF THE INVENTION

Hence, it is an object of the present invention to make it possible to evaluate whether or not the diagnosis of a response delay in the variable valve mechanism adapted for changing the operating characteristics of the engine valve functions normally, thereby enhancing the reliability of the diagnosis of the response delay.

To achieve the above object, in accordance with the present invention, a response of a control target of a variable valve mechanism is degraded in a forcible manner, thereby forcibly degrading the transient response of the variable valve mechanism, the transient response of the variable valve mechanism is diagnosed in the state of such a forcibly degraded transient response, and a diagnostic function of the transient response is evaluated based on the diagnosis result of the transient response.

The other objects and features of this invention will become understood from the following description with reference to the accompanying drawing.

DESCRIPTION OF A PREFERRED EMBODIMENT

Figure 1:
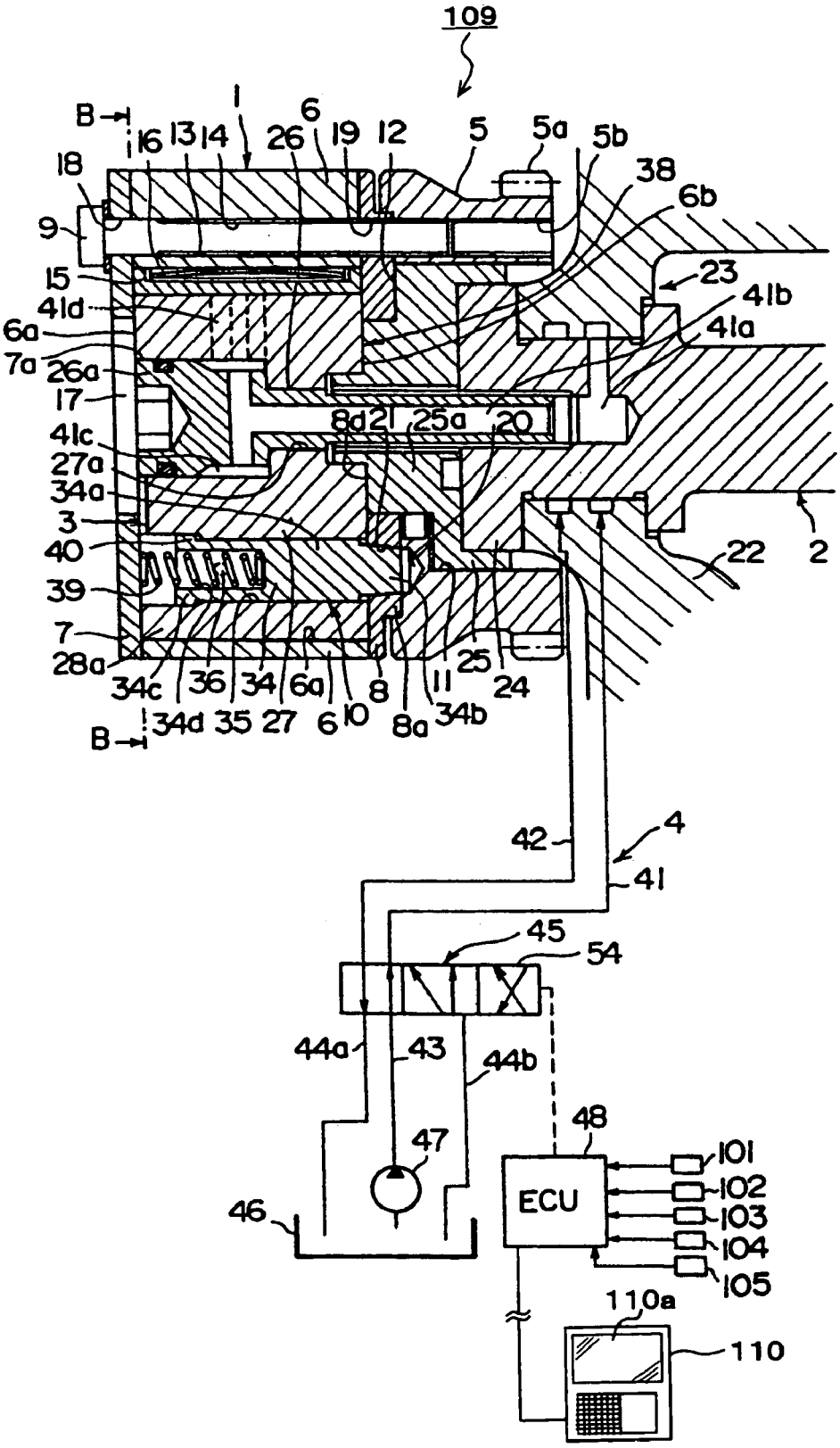
FIG. 1 is a cross-sectional view showing a variable valve timing apparatus according to an embodiment of the present invention.
Figure 2:
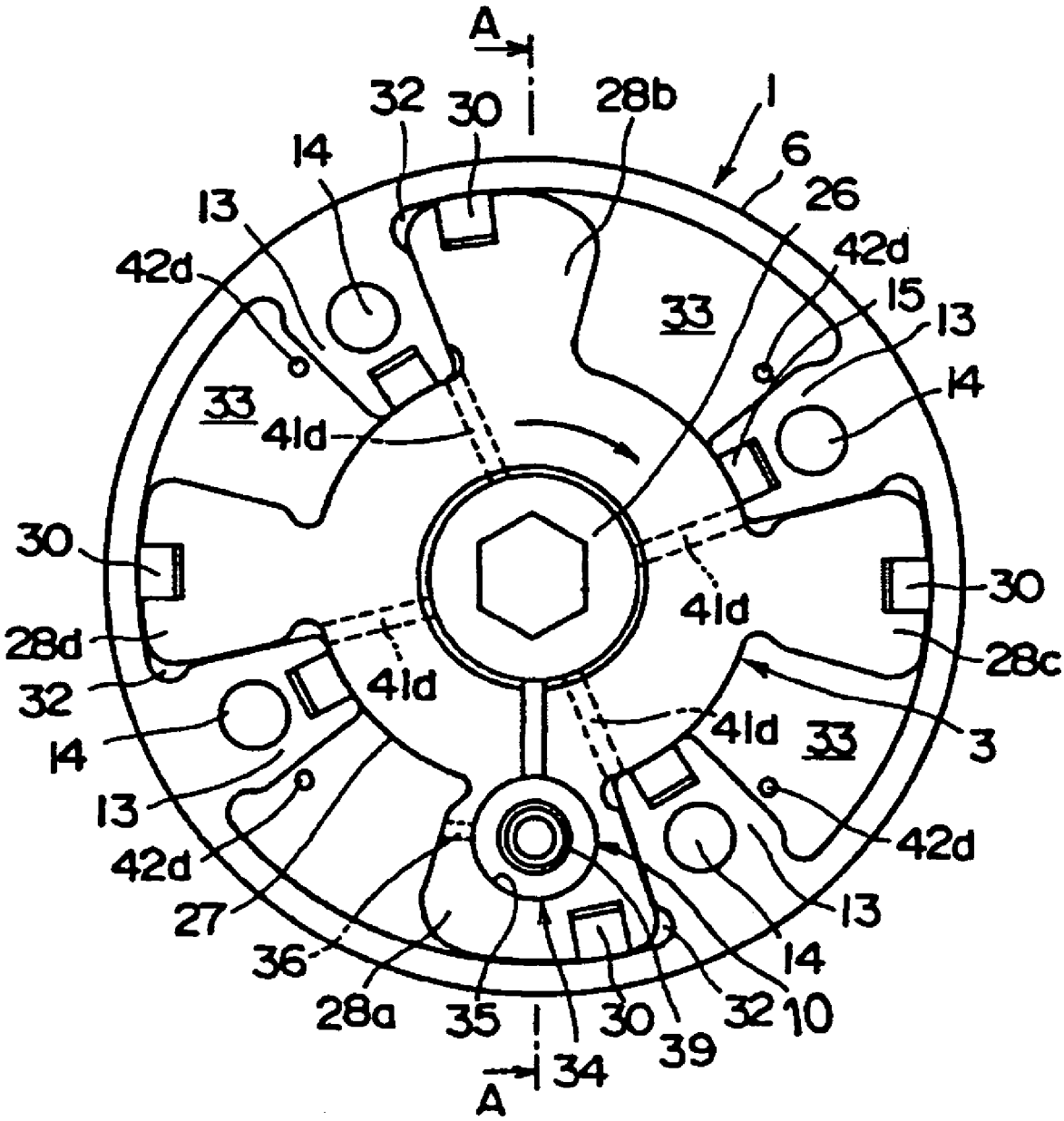
FIG. 2 is a cross-sectional view of the variable valve timing apparatus, taken along the line B-B in FIG. 1.
Figure 3:
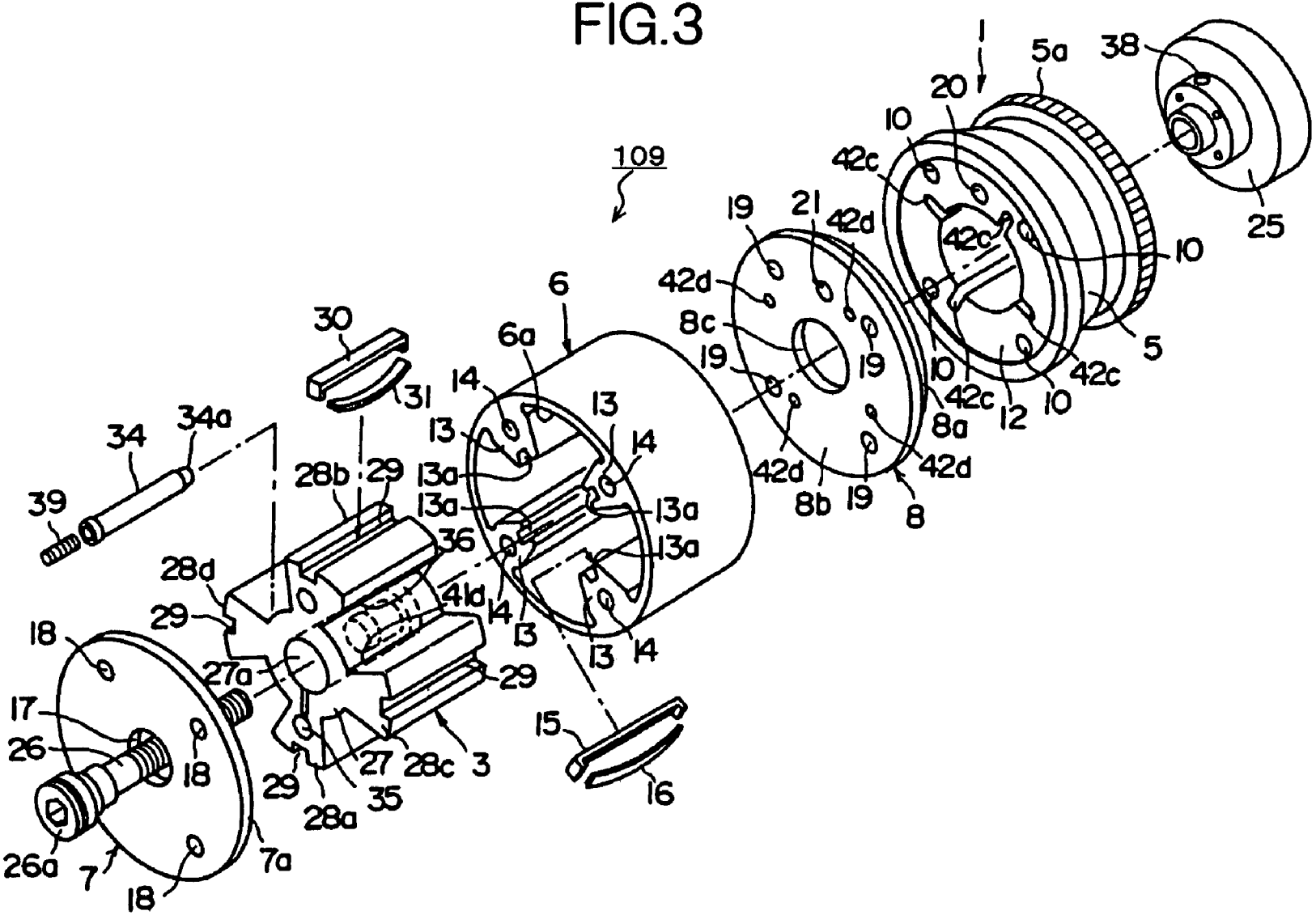
FIG. 3 is an exploded perspective view of the variable valve timing apparatus.

FIGS. 1 through 6 show variable valve timing apparatus 109 embodying a variable valve mechanism employed in the present invention, and variable valve timing apparatus 109 is typically but not exclusively applied to an intake valve side in a vehicular internal combustion engine.

The illustrated variable valve timing apparatus 109 includes cam sprocket 1 which is rotated by a crankshaft (not shown) of the engine through a timing chain, camshaft 2 provided such that camshaft 2 can rotate relative to cam sprocket 1, rotation member 3 which is fixed to an end of camshaft 2 and rotatably accommodated in cam sprocket 1, hydraulic circuit 4 for rotating rotation member 3 relative to cam sprocket 1, and lock mechanism 10 for selectively locking a relative rotation position between cam sprocket 1 and rotation member 3 at a predetermined position.

Cam sprocket 1 includes rotation member 5 provided at its outer periphery with teeth Sa with which the timing chain meshes, housing 6 which is disposed in front of rotation member 5 and in which rotation member 3 is rotatably accommodated, front cover 7 for closing a front end opening of housing 6, and rear cover 8 which is disposed between housing 6 and rotation member 5 for closing a rear end of housing 6. These rotation member 5, housing 6, front cover 7 and rear cover 8 are integrally couple to each other from an axial direction by means of four small-diameter bolts 9.

Rotation member 5 is of substantially annular shape. Four female thread holes 5*b* are formed in rotation member 5 so as to penetrate rotation member 5 in its longitudinal direction at four positions equidistantly spaced apart about 90° from one another in the circumferential direction. Small-diameter bolts 9 are threadedly engaged in female thread holes 5*b*. Fitting bore 11 whose diameter is changed in a stepwise manner is formed in rotation member 5 at its central position such as to penetrate rotation member 5. Later-described sleeve 25 for constituting a passage is fitted into fitting bore 11.

Rotation member 5 is formed at its front surface with circular fitting groove 12 in which rear cover 8 is fitted.

Housing 6 is of cylindrical shape whose front and rear ends are opened. Four division wall sections 13 radially internally project from an inner peripheral surface of housing 6 at positions spaced apart approximately 90° from one another in the circumferential direction.

Each of division wall sections 13 has a trapezoidal cross section and is provided so as to extend along the axial direction of housing 6. Both end edges of division wall 13 are formed so as to be flush with both end edges of housing 6, and four bolt-through holes 14 are formed in a base end of division wall 13 such as to penetrate division wall 13 in the axial direction. Small-diameter bolts 9 are inserted into bolt-through holes 14.

A central portion of an inner end surface of each division wall 13 is cut in a notch extending in the axial direction while forming holding groove 13*a*. U-shaped seal member 15 and leaf spring 16, which pushes seal member 15 inward are fitted in and held in holding groove 13*a*.

Bolt-through hole 17 having relatively large diameter is centrally formed in front cover 7. Four bolt holes 18 are formed through front cover 7 at locations corresponding to bolt-through holes 14 of housing 6.

Rear cover 8 is provided at its rear end surface with circular plate 8*a*, which is fitted into and held in fitting groove 12 of rotation member 5. Rear cover 8 is also provided at its central portion with fitting hole 8*c*. Small-diameter annular portion 25*a* of sleeve 25 is fitted into fitting hole 8*c*. Four bolt holes 19 are formed in rear cover 8 at locations corresponding to bolt-through holes 14.

Camshaft 2 is rotatably supported by an upper end portion of cylinder head 22 through cam bearing 23. A cam (not shown) for opening an intake valve is integrally formed on a predetermined position of an outer peripheral surface of camshaft 2 through a valve lifter. Flange portion 24 is alto integrally formed on a front end portion of camshaft 2.

Rotation member 3 is fixed to a front end of camshaft 2 by fixing bolt 26 inserted from the axial direction through sleeve 25. A front portion and a rear portion of sleeve 25 are fitted into flange portion 24 and fitting bore 11, respectively. Rotation member 3 is provided at its central portion with annular base portion 27 having bolt-through hole 27*a* into which fixing bolt 26 is inserted. Four vanes 28*a*, 28*b*, 28*c* and 28*d* are integrally formed on an outer peripheral surface of base portion 27 at locations away from one another through 90° in the circumferential direction thereof.

Each of first to fourth vanes 28*a* to 28*d* has approximately trapezoidal cross section. First to fourth vanes 28*a* to 28*d* are disposed in recesses between division wall sections 13, vanes 28*a* to 28*d* divide the corresponding recesses in front and rear portions, respectively, in the rotating direction, and thus advance angle hydraulic chamber 32 and lag angle hydraulic chamber 33 are defined between both sides of each of vanes 28*a* to 28*d* and both side surfaces of each of division wall sections 13.

Central portion of the outer peripheral surfaces of respective vanes 28*a* to 28*d* are cut in a notch extending in the axial direction to form axial holding grooves 29. U-shaped seal member 30 which comes into slide contact with inner peripheral surface 6*a* of housing 6, and leaf spring 31 which pushes seal member 30 outward are fitted in holding grooves 29 so as to be held therein.

Lock mechanism 10 is provided by including engagement groove 20 formed at a predetermined position on an outer periphery of fitting groove 12 of rotation member 5, engagement hole 21 formed as an internally tapered hole bored through a predetermined position of rear cover 8 corresponding to the above-mentioned engagement groove 20, sliding hole 35 formed through an approximately central position of one of vanes 28 to extend in an axial direction corresponding to the axial direction of engagement hole 21, lock pin 34 slidably provided in sliding hole 35 of one vane 28, coil spring 39 which is a spring member disposed to be compressed on the rear end side of lock pin 34, and pressure receiving chamber 40 formed between lock pin 34 and sliding hole 35.

Lock pin 34 includes central main body 34*a* having medium diameter, tapered conical engagement portion 34*b* formed on the tip end side of main body 34*a*, and stepped stopper portion 34*c* having large diameter formed on the rear end side of main body 34*a*.

Lock pin 34 is urged toward engagement hole 21 by a spring force of coil spring 39 compressed between a bottom surface of internal recessed groove 34*d* of stopper portion 34*c* and an inner end surface of front cover 7. Pressure receiving chamber 40 is formed between an inner peripheral surface of sliding hole 35 and an outer peripheral surface between main body 34*a* and stopper portion 34*c*. Lock pin 34 slides in a direction in which lock pin 34 is withdrawn from engagement hole 21 by hydraulic pressure prevailing in pressure receiving chamber 40.

Pressure receiving chamber 40 is in communication with lag angle hydraulic chamber 33 by through hole 36 formed in a side of vane 28.

Engagement portion 34*b* of lock pin 34 is engaged in engagement hole 21 in a turning position of the maximum lag angle side of rotation member 3.

Hydraulic circuit 4 includes two hydraulic pressure passages, i.e., first hydraulic pressure passage 41 for supplying and discharging hydraulic pressure to and from advance angle hydraulic chamber 32, and second hydraulic pressure passage 42 for supplying and discharging hydraulic pressure to and from lag angle hydraulic chamber 33. Supply passage 43 and drain passage 44 are respectively connected to hydraulic pressure passages 41 and 42 through passage switching solenoid switching valve 45.

Supply passage 43 is provided with oil pump 47 for pumping oil in oil pan 46, and a downstream end of drain passage 44 is in communication with oil pan 46.

First hydraulic pressure passage 41 includes first passage portion 41*a* formed from an interior of cylinder head 22 to an interior of camshaft 2, first oil passage 41*b* which is branched off in head 26*a* through fixing bolt 26 in the axial direction and which is in communication with first passage portion 41*a*, oil chamber 41*c* which is formed between a small-diameter outer peripheral surface of head 26*a* and an inner peripheral surface of bolt-through hole 27*a* formed in base portion 27 of rotation member 3 and which is in communication with first oil passage 41*b*, and four branch passages 41*d* which are formed substantially radially in base portion 27 of rotation member 3 and which are in communication with oil chamber 41*c* and advance angle hydraulic chamber 32.

On the other hand, second hydraulic pressure passage 42 includes second passage portion 42*a* formed in cylinder head 22 and in one side in camshaft 2, second oil passage 42*b* which is bent into substantially L-shape in sleeve 25 and which is in communication with second passage portion 42*a*, four oil passage grooves 42*c* which are formed in outer peripheral hole of fitting hole 11 of rotation member 5 and which is in communication with second oil passage 42*b*, and four oil holes 42*d* which are formed in rear cover 8 at position spaced apart approximately 90° from one another in the circumferential direction and which bring oil passage groove 42*c* and lag angle hydraulic chamber 33 into communication.

Solenoid switching valve 45 is provided therein with a spool valve body. The spool valve body relatively switches hydraulic pressure passages 41 and 42, supply passage 43 and drain passages 44*a* and 44*b*. Solenoid switching valve 45 is switched by a control signal from engine control unit 48.

Figure 4:
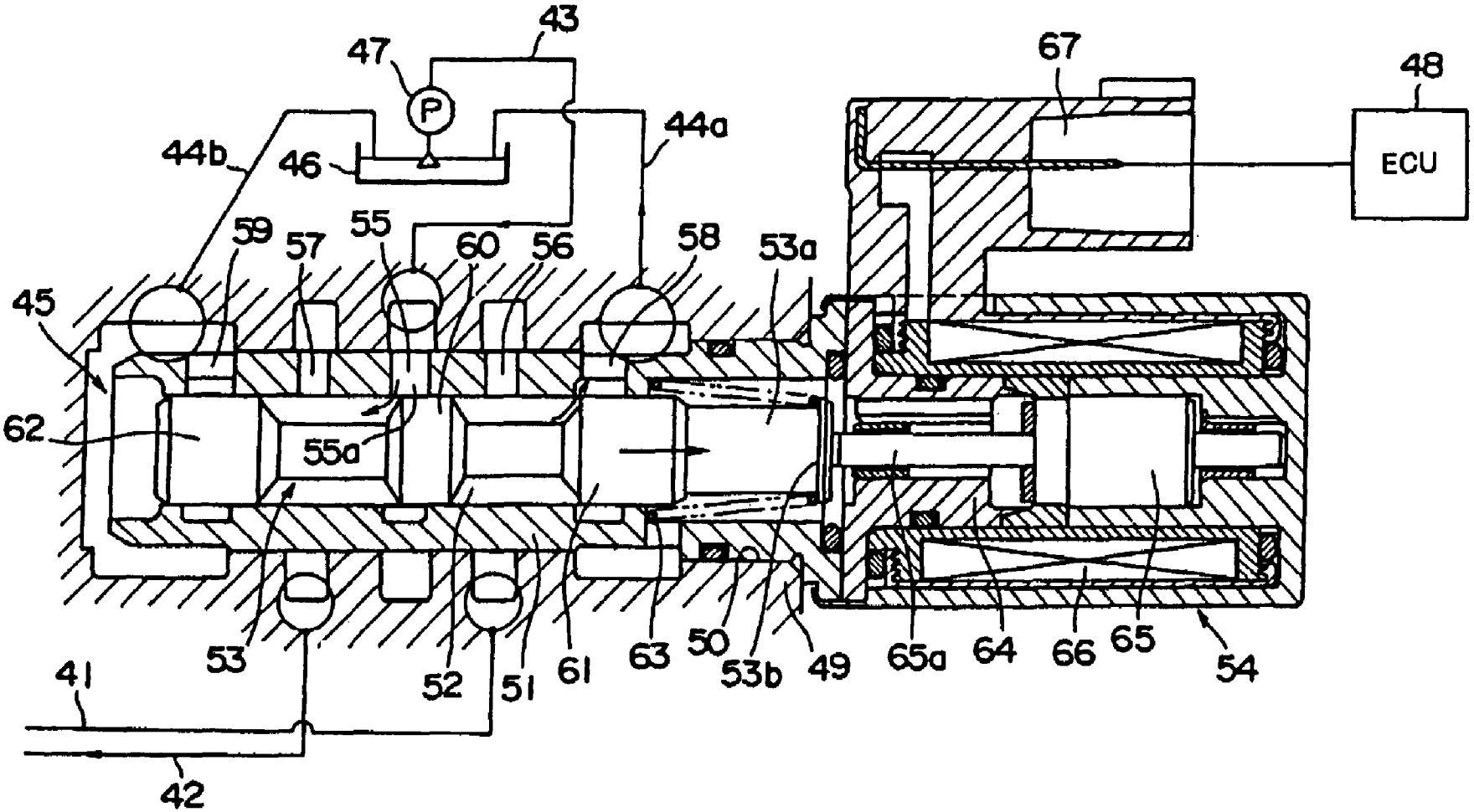
FIG. 4 is a longitudinal cross-sectional view showing a solenoid switching valve employed in the variable valve timing apparatus.
Figure 5:
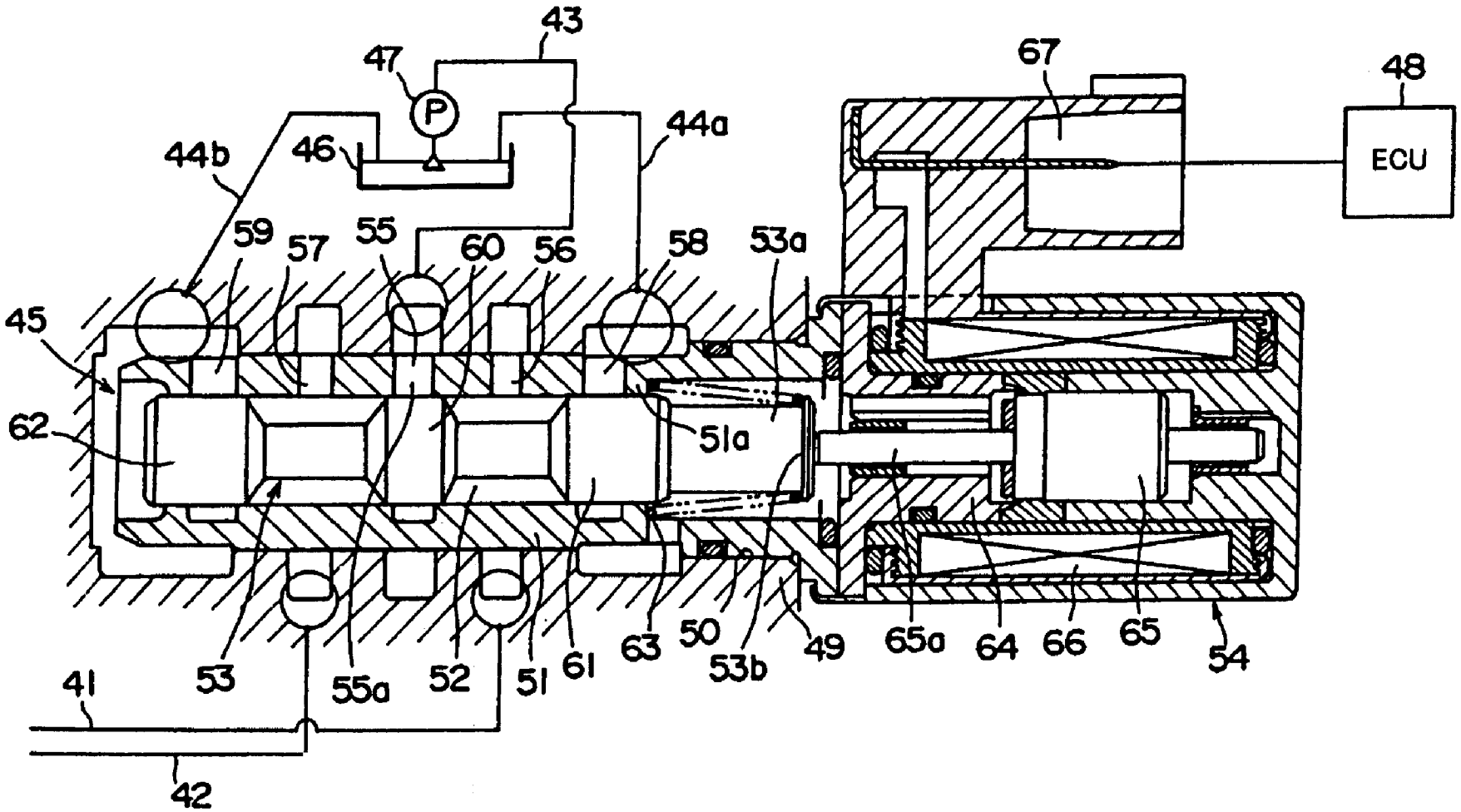
FIG. 5 is a similar longitudinal cross-sectional view of the same solenoid switching valve in the variable valve timing apparatus but showing a different state thereof.
Figure 6:
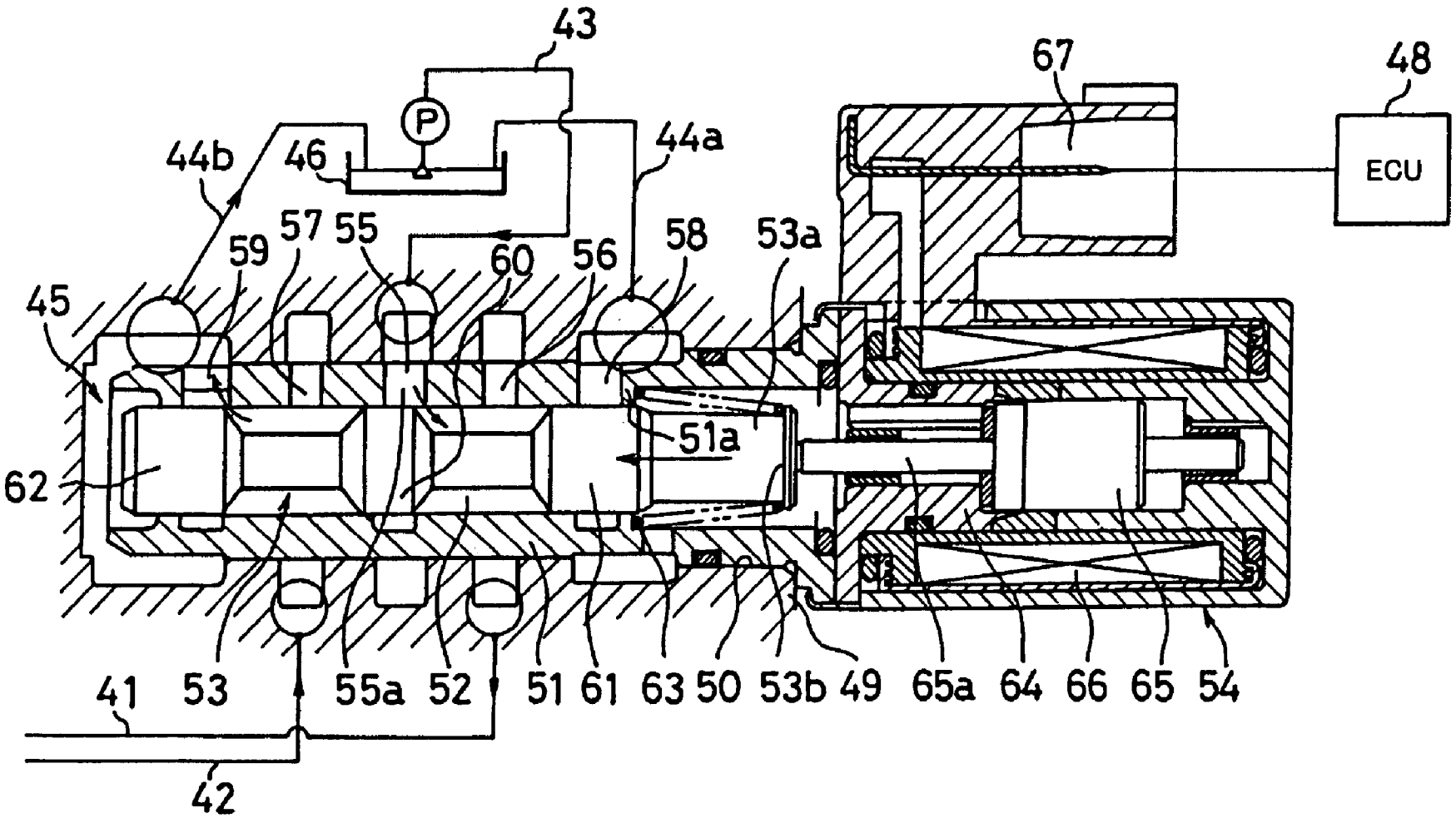
FIG. 6 is a similar longitudinal cross-sectional view of the same solenoid switching valve in the variable valve timing apparatus but showing a further different state thereof.

More specifically, as shown in FIGS. 4 to 6, solenoid switching valve 45 includes cylindrical valve body 51 which is inserted into and fixed into holding hole 50 of cylinder block 49, spool valve body 53 which is slidably provided in valve hole 52 of valve body 51 and which switches flow path, and proportional solenoid type electromagnetic actuator 54 for operating spool valve body 53.

Supply port 55 is formed into valve body 51 such as to penetrate valve body 51 at substantially central position of peripheral wall. Supply port 55 brings a downstream end of supply passage 43 and valve hole 52 into communication with each other. First port 56 and second port 57 are formed in both sides of supply port 55 such as to penetrate the same. First port 56 and second port 57 bring the other ends of first and second hydraulic pressure passages 41 and 42 and valve hole 52 with each other at both sides of supply port 55.

Third and fourth ports 58 and 59 are formed in both ends of the peripheral wall. Third and fourth ports 58 and 59 bring both drain passages 44*a* and 44*b* and valve hole 52 into communication with each other.

Spool valve body 53 has a small diameter shaft, the small diameter shaft is provided at its central portion with a substantially columnar first valve portion 60 which opens and closes supply port 55. The small diameter shaft is also provided at its both ends with substantially columnar second and third valve portions 61 and 62 which open and close third and fourth ports 58 and 59.

Spool valve body 53 is constantly urged rightward in the drawing, i.e., in a direction in which first valve portion 60 brings supply port 55 and second hydraulic pressure passage 42 into communication with each other by means of conical valve spring 63 which is elastically interposed between a bevel portion 53*b* on one end edge of a front end support shaft 53*a* and spring sheet 51*a* of a front end inner peripheral wall of valve hole 52.

Electromagnetic actuator 54 includes core 64, movable plunger 65, coil 66, connector 67 and the like. Driving rod 65*a* for pushing bevel portion 53*b* of spool valve body 53 is fixed to a tip end of movable plunger 65.

Engine control unit 48 detects a current operation state (engine load, engine rotating speed) by signals from rotation sensor 101 which detects engine rotating speed, and flow meter 102, which detects intake air amount of the engine. Engine control unit 48 also detects a relative turning position between cam sprocket 1 and camshaft 2 by signals from crank angle sensor 103 and cam sensor 104, i.e., detects rotation phase of camshaft 2 with respect to crankshaft.

Engine control unit 48 controls a quantity of power supply to electromagnetic actuator 54 based on a duty control signal.

For example, if a control signal (OFF signal) of duty ratio of 0% is output to electromagnetic actuator 54 from engine control unit 48, spool valve body 53 is moved to a position shown in FIG. 4 by a spring force of valve spring 63 in the most rightward direction.

With this, first valve portion 60 opens opening end 55*a* of supply port 55, brings the same into communication with second port 57, and second valve portion 61 opens an opening end third port 58 and fourth valve portion 62 closes fourth port 59 at the same time.

Thus, working oil pumped from oil pump 47 is supplied to lag angle hydraulic chamber 33 through supply port 55, valve hole 52, second port 57 and second hydraulic pressure passage 42, and working oil in advance angle hydraulic chamber 32 is discharged into oil pan 46 from first drain passage 44*a* through first hydraulic pressure passage 41, first port 56, valve hole 52 and third port 58.

Therefore, internal pressure in lag angle hydraulic chamber 33 becomes high, and internal pressure in advance angle hydraulic chamber 32 becomes low. Thus, rotation member 3 is rotated, via vanes 28*a* to 28*b*, in one direction to the maximum.

With this, cam sprocket 1 and camshaft 2 are relatively turned toward one side and phase is varied. As a result, opening timing of intake valve is delayed, and overlap of exhaust valve is reduced.

On the other hand, if a control signal (ON signal) of duty ratio of 100% is output from engine control unit 48 to electromagnetic actuator 54, spool valve body 53 slides leftward to the maximum as shown in FIG. 6 against a spring force of valve spring 63, third valve portion 61 closes third port 58 and at the same time, fourth valve portion 62 opens fourth port 59, and first valve portion 60 brings supply port 55 and first port 56 into communication with each other.

Thus, working oil is supplied into advance angle hydraulic chamber 32 through supply port 55, first port 56 and first hydraulic pressure passage 41, working oil in lag angle hydraulic chamber 33 is discharged into oil pan 46 through second port 57, fourth port 59 and second drain passage 44*b*, and pressure in lag angle hydraulic chamber 33 is reduced.

Therefore, rotation member 3 rotates in the other direction at the maximum through vanes 28*a* to 28*d* and with this, cam sprocket 1 and camshaft 2 relatively turn toward the other side and their phases are varied and as a result, opening timing of the intake valve is advanced, and overlap with respect to the exhaust valve is increased.

In engine control unit 48, duty ratio at which first valve portion 60 closes supply port 55, third valve portion 61 closes third port 58, and fourth valve portion 62 closes fourth port 59 is set as base duty ratio BASEDTY. On the other hand, feedback correction amount UDTY for bringing rotation phases of cam sprocket 1 and camshaft 2 which are detected based on signals from crank angle sensor 103 and cam sensor 104, and desired value (desired advance angle value) of the rotation phase which is set in accordance with the operation state to be matched with each other.

The sum of base duty ratio BASEDTY and feedback correction amount UDTY is defined as a final duty ratio VTCDTY, and a control signal of this duty ratio VTCDTY is output to electromagnetic actuator 54.

Base duty ratio BASEDTY is set to substantially intermediate value (e.g., 50%) on a duty ratio range where supply port 55, third port 58 and fourth port 59 are closed, and oil is not supplied to any of hydraulic chambers 32 and 33.

That is, when it is necessary to change the rotation phase toward the lag angle, the duty ratio is reduced by the feedback correction amount UDTY, working oil pumped from oil pump 47 is supplied to lag angle hydraulic chamber 33, and working oil in advance angle hydraulic chamber 32 is discharged into oil pan 46.

When it is necessary to change the rotation phase toward the advance angle, the duty ratio is increased by the feedback correction amount UDTY, working oil pumped from oil pump 47 is supplied to advance angle hydraulic chamber 32, and working oil in lag angle hydraulic chamber 33 is discharged into oil pan 46.

When the current state of the rotation phase is to be held, control is performed such that the duty ratio is returned to a value close to the base duty ratio by reducing the absolute value of feedback correction amount UDTY, supply port 55 and third port 58 are closed (supply of hydraulic pressure is stopped) to hold the internal pressure of hydraulic chambers 32 and 33.

Engine control unit 48 has a function for executing feedback control of the duty ratio of a duty control signal, which is to be output by engine control unit 48 to electromagnetic actuator 54 by means of the proportional plus integral plus differential controlling on the basis of a deviation between a desired advance angle value and the actual advance angle value. Engine control unit 48 also has a function for diagnosing a response delay which might occur in variable valve timing apparatus 109.

The diagnosis is executed based on, for example, a time required for the actual advance angle value to be converged to the desired advance angle value from the time when the desired advance angle value is changed in a step-like manner, a duration of time during which a state such that the deviation between the desired advance angle value and the actual advance angle value is equal to or larger than a predetermined value lasts, and changing speed of the actual advance angle value immediately after the desired advance angle value is changed in the step-like manner.

When it is determined that the response delay is generated as a result of diagnosis of the response delay, a user of the vehicle is alerted or warned about the trouble of variable valve timing apparatus 109 and this alert encourages the vehicle user to practice maintenance of the vehicle.

If the response diagnostic function is not normally functioned, even when the response delay of variable valve timing apparatus 109 is generated, it is not possible to alert the user to the trouble, and the driver drives the vehicle in a state where the operation of the internal combustion engine is deteriorated.

Hence, in this embodiment, it is evaluated whether the response diagnostic function normally functions as will be described below.

Figure 7:
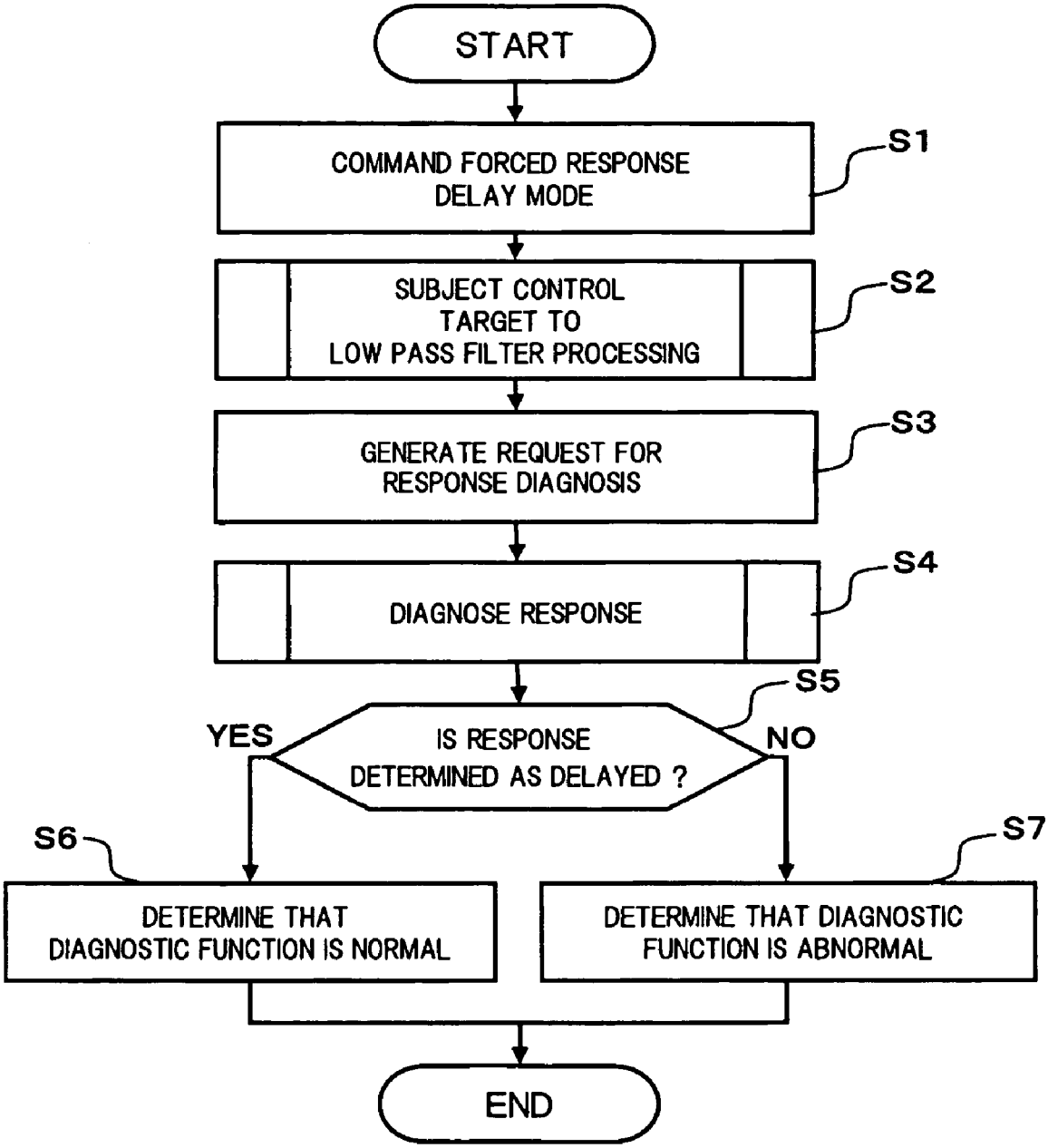
FIG. 7 is a flowchart showing evaluation processing of a diagnostic function according to the present invention.

When the function of the response diagnosis is evaluated, external tester 110 is connected to engine control unit 48 to execute the evaluation of the diagnostic function as shown in the flowchart in FIG. 7.

In the flowchart in FIG. 7, firstly in step S1, external tester 110 commands engine control unit 48 to proceed to the procedure to a mode for forcibly degrading the transient response of variable valve timing apparatus 109.

In step S2, engine control unit 48 which receives the command subjects the desired advance angle value to a low pass filter processing, and variable valve timing apparatus 109 is feedback-controlled based on the desired advance angle value which was subjected to the low pass filter processing.

Figure 8:
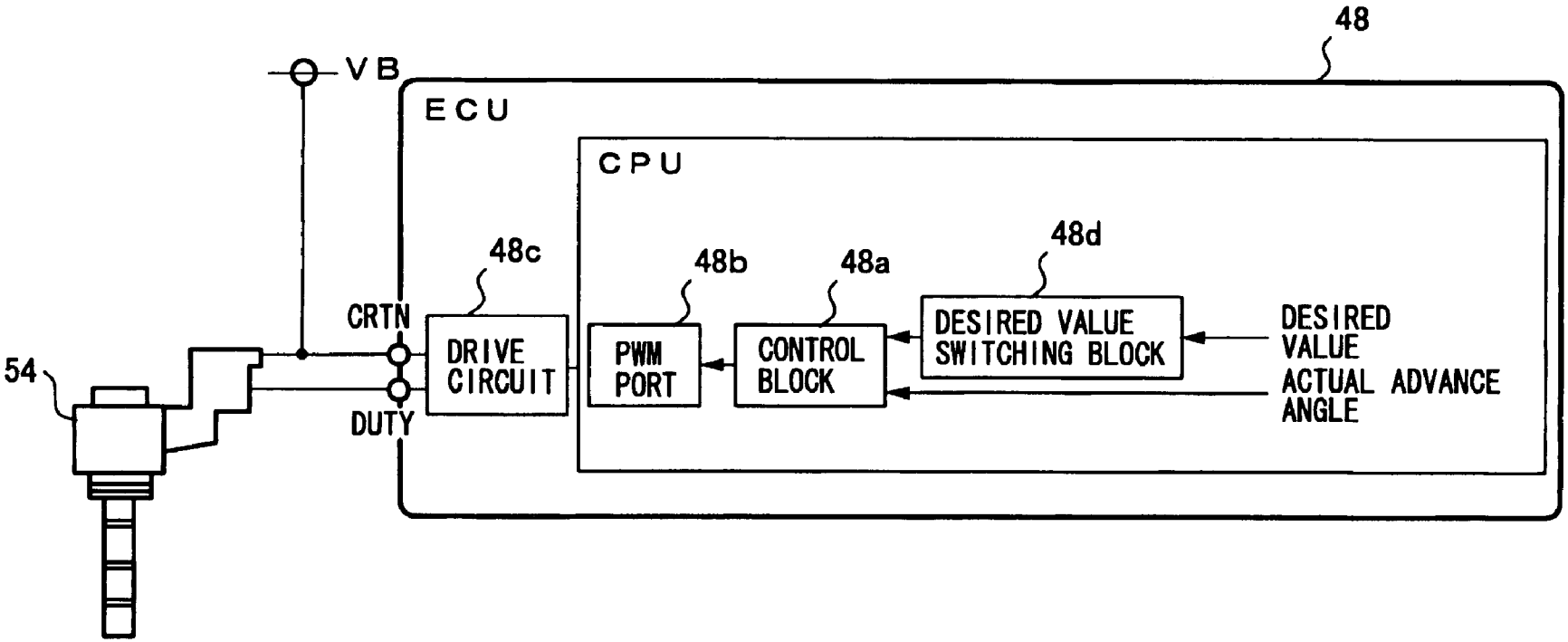
FIG. 8 is a block diagram showing a feedback-control system of a variable valve timing apparatus of the embodiment.

In control block 48*a* of engine control unit 48, as shown in FIG. 8, a duty ratio VTCDTY comprising a base duty ratio BASEDTY and a feedback correcting amount UDTY is calculated based on the desired advance angle value and the actual advance angle value, and a pulse signal corresponding to the duty ratio VTCDTY is output from PWM port 48*b*.

Drive circuit 48*c* conducts duty controlling of the quantity of power supply to electromagnetic actuator 54 based on the pulse signal, which is delivered as an output from PWM port 48*b*.

Here, desired value switching block 48*d* is interposed in an output line of the desired advance angle value to control block 48*a*.

Figure 9:
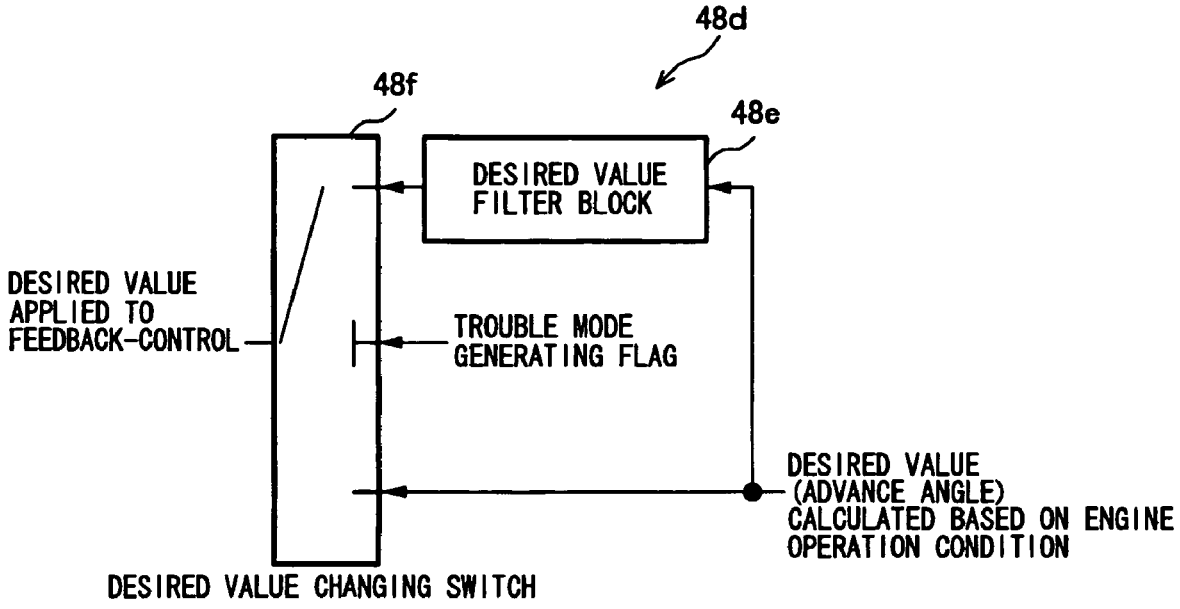
FIG. 9 is a block diagram showing details of a desired value switching block shown in FIG. 8.

As shown in FIG. 9, in desired value switching block 48*d*, the desired advance angle value calculated based on the engine operating condition is subjected to a low pass filter processing (for example, first-order lag processing) by desired value filter block 48*e*, and then input to one of input ports of desired value changing switch 48*f*, and the desired advance angle value calculated based on the engine operating condition is supplied, as an input as is, to the other input port of desired value changing switch 48*f*.

Desired value changing switch 48*f* carries out the switching operation in accordance with a command, which is output from external tester 110 to engine control unit 48. Desired value changing switch 48*f* usually outputs a desired advance angle value which is obtained without proceeding through desired value filter block 48*e* to control block 48*a*, and if a command for degrading the transient response is input from external tester 110, desired value changing switch 48*f* outputs the desired advance angle value obtained through desired value filter block 48*e* to control block 48*a*.

Figure 11:
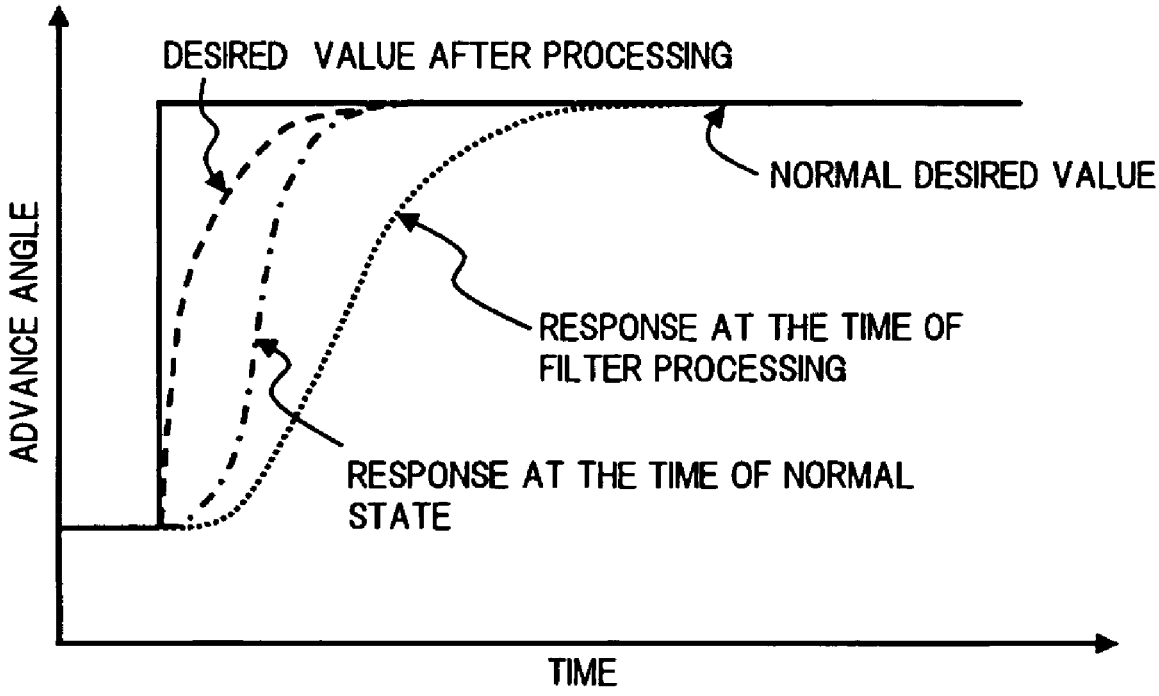
FIG. 11 is a time chart showing a correlation between a desired advance angle value and an actual advance angle value in the embodiment.

If the desired advance angle value is subjected to the low pass filter processing by desired value filter block 48*e*, the desired advance angle value used for duty controlling of electromagnetic actuator 54 is delayed from the transient response of the original desired advance angle value. As a result, the transient response of variable valve timing apparatus 109 is delayed from a normal transient response, which is not subjected to the low pass filter processing (see FIG. 11).

In the low pass filter processing, the transient response of the desired advance angle value is delayed such that generation of response delay is diagnosed if the response diagnosis normally functions.

The low pass filter processing includes a known processing for delaying the transient response of the input signal such as a digital filter and weighted average calculation, and filter processing may be carried out using the desired advance angle value as an analogue signal.

The generation level of the response delay caused by the low pass filter processing varies depending upon the engine operating condition and therefore, in correspondence with the variation in the generation level of the response delay, a time constant in the low pass filter processing may be varied in accordance with the engine operating condition.

If external tester 110 commands to proceed the procedure to the mode for forcibly delaying the transient response, external tester 110 outputs an execution requesting signal of response diagnosis to engine control unit 48 in step S3.

Engine control unit 48 which receives the execution requesting signal of the response diagnosis carries out the response diagnosis in step S4.

Figure 10:
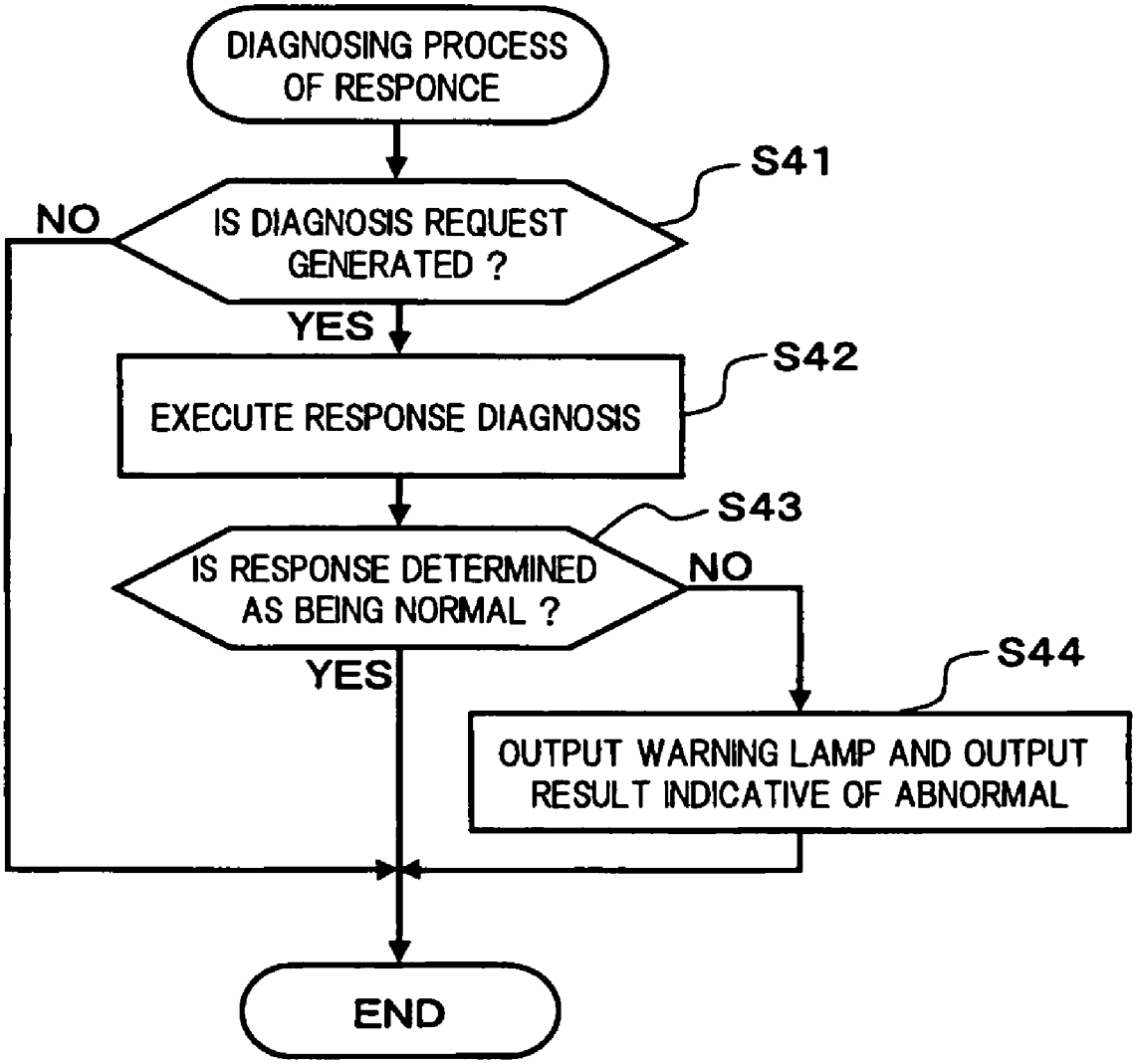
FIG. 10 is a flowchart showing response diagnosing processing in the embodiment.

Details of the response diagnosis carried out in step S4 are shown in a flowchart in FIG. 10.

In step S41, it is determined whether or not the request for response diagnosis is generated, and if it is determined that the request for response diagnosis is generated, the procedure proceeds to step S42.

In step S42, it is determined whether or not response of variable valve timing apparatus 109 is deteriorated based on time required for the actual advance angle value to be converged into the desired advance angle value after the desired advance angle value is changed in a step manner, duration of a state in which the deviation between the desired advance angle value and the actual advance angle value is equal to or more than a predetermined value, and changing speed of the actual advance angle value immediately after the desired advance angle value is changed in the step manner.

All of the desired advance angle values in the description of the response diagnosis are desired advance angle values before being subjected to the low pass filter processing.

In step S43, as a result of the response diagnosis, it is determined whether or not the response of variable valve timing apparatus 109 is diagnosed as being normal.

If the response is diagnosed as being deteriorated, the procedure proceeds to step S44, where a warning lamp for alerting the user to the response deterioration (trouble of variable valve timing apparatus 109) is lit and a diagnosis result of the response deterioration is output.

If the above-described normal response diagnosis is carried out, it is determined whether or not the response of variable valve timing apparatus 109 is diagnosed as being deteriorated in step S5 in the flowchart in FIG. 7.

Since the desired advance angle value is subjected to the low pass filter processing for forcibly delaying the transient response in step S2, if the function of the response diagnosis is normal, the transient response should be diagnosed as being delayed.

Therefore, when the transient response is diagnosed as being normal, the response is erroneously diagnosed as being normal although the response is deteriorated in the reality, so that it can be determined that the diagnostic function is abnormal.

Hence, if the response is diagnosed as being deteriorated in step S4, the procedure proceeds to step S6 from step S5, the response diagnosis is evaluated as functioning normally, and such an evaluation result is output.

The evaluation result is output as display of characters "diagnostic function is normal" on screen 110*a* of external tester 110.

On the other hand, if the response is not diagnosed as being deteriorated in step S4, this means that although the transient response is sent by the low pass filter processing of the desired advance angle value in the reality, the transient response is erroneously diagnosed as being normal. Thus, the procedure proceeds to step S7 from step S5, the diagnostic function is evaluated as being abnormal, and such evaluation result is output.

The evaluation result is output, for example, as display of characters "diagnostic function is abnormal" on screen 110*a* of external tester 110.

With this, the abnormal condition of the diagnostic function is detected, and the diagnostic function can be recovered. Thus, the reliability of the diagnostic function can be enhanced.

The variable valve mechanism is not limited to the aforesaid hydraulic pressure type variable valve timing apparatus 109. The variable valve mechanism may be of a structure in which a rotation phase of a cam shaft is changed with respect to a crankshaft by friction brake of an electromagnetic clutch (electromagnetic brake) disclosed in Japanese Unexamined Patent Publications No. 2001-164951 and No. 10-153104, or may be of a mechanism in which a control shaft is turned by a motor, and a valve lift amount of an engine value is continuously changed together with the operation angle as disclosed in Japanese Unexamined Patent Publication No. 2001-012262. The control signal is not limited to a duty signal.

Engine control unit 48 may evaluated the diagnosis response without using external tester 110, and engine control unit 48 may evaluate the diagnostic function at appropriate timing in an operation condition of a user.

The entire contents of Japanese Patent Application NO. 2004-334725, filed Nov. 18, 2004 are incorporated herein by reference.

While only selected embodiments have been chosen to illustrate the present invention, it will be apparent to those skilled in the art from this disclosure that various change and modification can be made herein without departing from the scope of the invention as defined in the appended claims.

Furthermore, the foregoing description of the embodiments according to the present invention are provided for illustration only, and not for the purpose of limiting the invention as defined by the appended claims and their equivalents.

We claim:

1. An evaluation method of a diagnostic function for diagnosing a transient response of a variable valve mechanism adapted for varying operating characteristics of an engine valve, comprising the steps of:

degrading a transient response of the variable valve mechanism in a forcible manner by way of forcibly degrading a response of a control target of the variable valve mechanism;

diagnosing the transient response of the variable valve mechanism in a state of the forcibly degraded transient response of the variable valve mechanism; and evaluating a diagnostic function of the transient response based on a diagnosis result of the transient response.

2. The evaluation method according to claim 1, wherein the step of degrading the response of the control target in the forcible manner includes the following steps of:

subjecting the control target of the variable valve mechanism to a filter processing; and controlling the variable valve mechanism based on the control target after the filter processing.

3. The evaluation method according to claim 2, wherein the step of diagnosing the transient response includes the step of executing said diagnosing based on both a transient response at a time when the variable valve mechanism is controlled on the basis of the control target after the filter processing, and a control target before the filter processing.

4. The evaluation method according to claim 2, wherein the step of diagnosing the transient response includes the step of executing said diagnosing based on both an actual operation characteristics at a time when the variable valve mechanism is feedback-controlled based on a control target after the filter processing, and a control target before the filter processing.

5. The evaluation method according to claim 2, wherein the step of subjecting the control target of the variable valve mechanism to the filter processing includes the steps of:

detecting an operation state of an internal combustion engine; and setting a time constant of the filter to be capable of varying in accordance with an engine operating condition.

6. The evaluation method according to claim 2, wherein the step of diagnosing the transient response includes the steps of:

feedback-controlling the variable valve mechanism in accordance with the filter-processed control target;

measuring time required for actual operation characteristics to be converged into the control target before the filter processing by the feedback-control, and diagnosing the transient response of the variable valve mechanism based on the time.

7. The evaluation method according to claim 2, wherein the step of diagnosing the transient response includes the steps of:

feedback-controlling the variable valve mechanism in accordance with the filter-processed control target;

measuring a duration of time during which such a state that a deviation between the control target before the filter processing and an actual operation characteristics is equal to or larger than a predetermined value lasts; and diagnosing the transient response of the variable valve mechanism based on the time.

8. The evaluation method according to claim 1, wherein the step of evaluating the diagnostic function includes a step of:

determining that the diagnostic function of the transient response is abnormal when the transient response is diagnosed as being normal.

9. The evaluation method according to claim 1, wherein the step of degrading the transient response of the variable valve mechanism in the forcible manner includes the steps of:

connecting an external tester to a control unit that controls the variable valve mechanism; and receiving a command for generating response delay by the control unit from the external tester to thereby forcibly degrade the response of the control target of the variable valve mechanism.

10. The evaluation method according to claim 1, wherein the step of diagnosing the transient response of the variable valve mechanism includes the steps of:

diagnosing said transient response in a state such that the transient response is forcibly degraded; and outputting a result of said diagnosis to an external tester.

11. The evaluation method according to claim 1, wherein the step of evaluating the diagnostic function of the transient response based on the diagnosis result of the transient response is executed by a control unit that controls the variable valve mechanism.

12. An evaluation apparatus for diagnosing a transient response of a variable valve mechanism adapted for varying operation characteristics of an engine valve; comprising:

a response delay generator that forcibly degrades a response of a control target of the variable valve mechanism;

a diagnosing unit that diagnoses a transient response of the variable valve mechanism under a condition such that the response delay generator is in operation; and an evaluating unit that evaluates a function of the diagnosing unit based on a result of diagnosis that the diagnosing unit has executed.

13. The evaluation apparatus according to claim 12, wherein the response delay generator comprises:

a filter-processing unit that executes filter-processing of a control target of the variable valve mechanism; and a feedback-controller that executes feedback-controlling of the variable valve mechanism based on the control target after being filter-processed.

14. The evaluation apparatus according to claim 12, wherein the transient response of the variable valve mechanism is diagnosed based on both the control target before being filter-processed and the transient response occurring at a time when feedback-controlling of the variable valve mechanism is executed based on the control target after being filter-processed by the response delay generator.

15. The evaluation apparatus according to claim 13, wherein the response delay generator comprises:

a detector that detects an operating state of an internal combustion engine; and a time constant changing unit that changes a time constant of a filter of the filter processing unit according to the operating state of the internal combustion engine.

16. The evaluation apparatus according to claim 14, wherein the diagnosing unit comprises:

a timer that counts a time required for actual operation characteristics of the engine valve to be converged to the control target before being filter-processed, when feedback-controlling of the variable valve mechanism is executed based on the control target after being filter-processed; and a transient response diagnosing unit that diagnoses the transient response of the variable valve mechanism based on the time counted by the timer.

17. The evaluation apparatus according to claim 14, wherein the diagnosing unit comprises:

a deviation calculator that calculates a deviation between the control target before being filter-processed and the actual operation characteristics;

a timer that counts a duration of time during which a state such that the deviation is equal to or larger than a predetermined value lasts; and a transient response diagnosing unit that diagnoses the transient response of the variable valve mechanism based on a result of counting of the timer.

18. The evaluation apparatus according to claim 14, wherein the variable valve mechanism is a mechanism that changes a phase of a camshaft with respect to a crankshaft, and wherein the diagnosing unit executes feedback-controlling of the variable valve mechanism based on a desired amount of the advance angle of the phase after said desired amount is filter-processed and an actual amount of the advance angle of the phase , and the transient response of the variable valve mechanism is diagnosed based on both the actual amount of the advance angle when said feedback-controlling is executed and a desired amount of the advance angle before said desired amount is filter-processed.

19. The evaluation apparatus according to claim 12, wherein when the transient response of the variable valve mechanism is diagnosed as being normal as a result of diagnosing of said transient response by the diagnosing unit, the evaluating unit determines that the diagnostic function of the diagnosing unit is abnormal.

20. The evaluation apparatus according to claim 12, wherein the evaluation apparatus further comprises a control unit that controls the variable valve mechanism, the control unit being provided with the response delay generator, and wherein when the response delay generator of the control unit receives a command for forcibly degrading the transient response from an external tester connected to the control unit, the response delay generator forcibly degrades the response of the control target of the variable valve mechanism.

21. The evaluation apparatus according to claim 12, wherein the evaluation apparatus further comprises a control unit that controls the variable valve mechanism, the diagnosing unit being provided for said control unit.

22. The evaluation apparatus according to claim 12, wherein the evaluation apparatus further an external tester which is different from a control unit that controls the variable valve mechanism, the evaluating unit being provided for said control unit.

23. The evaluation apparatus according to claim 12, wherein the evaluation apparatus further comprises a control unit that controls the variable valve mechanism, said control unit being provided for a different control unit that controls an internal combustion engine.

24. The evaluation apparatus according to claim 12, wherein the evaluation apparatus further comprises a control unit that controls the variable valve mechanism, said control unit being provided with an output unit that outputs a diagnosing result of the diagnosing unit to an external tester.

25. The evaluation apparatus according to claim 12, wherein the evaluation apparatus further comprises a control unit that controls the variable valve mechanism, said control unit being provided with an output unit that outputs an evaluation result of the evaluating unit to an external tester.

* * * * *